US005769263A

United States Patent [19]

Willingham et al.

[11] Patent Number: 5,769,263

[45] Date of Patent: Jun. 23, 1998

[54] COMPARTMENTALIZED TOP COVER PROMOTIONAL CLOSURE

[75] Inventors: Wendell D. Willingham, Zionsville; David W. Smith, Waynetown; David L. Cerny, Crawfordsville; Stephen W. McBride, Brownsburg, all of Ind.

[73] Assignee: Alcoa Closure Systems International, Inc., Crawfordsville, Ind.

[21] Appl. No.: 786,809

[22] Filed: Jan. 21, 1997

[51] Int. Cl.[6] ..... B65D 43/04

[52] U.S. Cl. ..... 220/522; 220/212; 215/6; 215/228

[58] Field of Search ..... 215/6, 228, 386; 220/212, 521, 522

[56] References Cited

U.S. PATENT DOCUMENTS

| | | | |
|---|---|---|---|
| 2,978,132 | 4/1961 | Huck | 215/6 X |
| 3,163,544 | 12/1964 | Valyi | 215/6 X |
| 3,367,484 | 2/1968 | Nelson | 215/6 X |
| 3,433,378 | 3/1969 | Ross | 215/6 |
| 3,519,005 | 7/1970 | Krezanoski et al. | 220/521 X |
| 4,475,654 | 10/1984 | Fruchter | 220/521 X |
| 5,056,659 | 10/1991 | Howes et al. . | |
| 5,103,990 | 4/1992 | Irwin . | |
| 5,524,788 | 6/1996 | Plester . | |

FOREIGN PATENT DOCUMENTS

| | | |
|---|---|---|
| 1.141.206 | 3/1957 | France . |
| 26 41 543 | 3/1977 | Germany . |

*Primary Examiner*—Stephen Cronin

*Attorney, Agent, or Firm*—Dressler, Rockey, Milnamow & Katz, Ltd.

[57] ABSTRACT

A promotional closure for use with an associated container includes a plastic closure cap having an inwardly recessed, circular top wall portion defining a compartment and a depending annular skirt portion depending from the top wall portion. A circumferential lip formed in the closure cap generally at about a periphery of the compartment, defines a circumferential channel-like recess adjacent to the compartment. The closure further includes a removable, circular cover member adapted to cover the compartment by insertion into the circumferential recess. The cover has a pair of circumferentially opposed tab-like, releasable engaging members which are adapted to be received in the circumferential recess to retain the cover in place in the cap over the compartment. The engaging members are further adapted to release from the recess for removal of the cover member from the top wall portion when pressure is applied to the cap on the skirt portion adjacent to where the engaging members are positioned in the recess to thereby permit access to the compartment. Alternately, the cover includes a depending skirtlike seal support member which exerts an outward force on the top wall portion to urge the top wall portion into sealing engagement with an inside surface at the mouth of the container.

27 Claims, 4 Drawing Sheets

COMPARTMENTALIZED TOP COVER PROMOTIONAL CLOSURE

FIELD OF THE INVENTION

This invention relates to promotional closures for containers and more particularly to promotional closures having a compartment that is accessible from a removable top cover.

BACKGROUND OF THE INVENTION

Various types of closures for containers such as those used for bottling soft drinks are known in the art. One such commonly used closure is formed of plastic and includes a circular top wall portion and an internally threaded depending skirt portion which threads onto an associated container. For enhanced sealing, many such closures include a liner positioned on the inside surface of the top wall.

Examples of such closures and methods of making such closures are disclosed in U.S. Pat. Nos. 5,205,426 to McBride et al. and 4,497,765 to Wilde et al, hereby incorporated by reference.

For many years, soft drink manufacturers and bottlers have used closures and closure liners for promotional campaigns. Common among the promotional purposes for which such container closures and liners are used includes redemption pieces for reduced pricing or rebates, and sweepstakes or game prize pieces.

In a typical promotional application, a logo or other representation for prize redemption, such as a prize award amount or item, is printed or transferred onto the inside of the closure cap.

There are, however, drawbacks to such a promotional use. When, for example, the closure has imprinted thereon a game piece, the entire closure must be redeemed. Redemption may cause problems both for the consumer who must package and send the closure to the bottler, and for the bottler who must collect and process the closures. With respect to the consumer, the closure is not easily placed in an envelope and sent through the mail. With respect to the bottler or manufacturer, the closures pose little problem in processing and handling singly or in small numbers, however, when large numbers of closures are involved, the processing and handling can become extremely burdensome and costly.

In another type of promotional use, a liner in the closure may have imprinted thereon the exemplary game piece. If the liner is of the insert type, a logo or other promotional indicia can be readily transferred onto the liner. The liner is then readily removed from the closure and redeemed. However, if the liner is removed before the container is emptied of its contents, the contents may leak, or if carbonated, may lose carbonation.

If, on the other hand, the liner is of the molded-in type other problems arise. First, because of the molding process, legible printing or transfer directly onto the liner is very difficult. Second, molded-in liners are normally adhered to the inside of the closure. Further, as with the insert type liner, if the liner is removed from the closure before the container is emptied, the contents may lose carbonation or leak.

Thus, there continues to be a need for a promotional closure which allows ready access to and removal of the promotional indicia before the associated container is emptied and which removal does not adversely affect the sealing capabilities of the closure. Such a closure further prevents access to the promotional indicia without removing the closure from the container.

SUMMARY OF THE INVENTION

A promotional closure embodying the principles of the present invention includes an inwardly recessed top wall portion and a depending skirt portion depending from the top wall portion. The inwardly recessed top wall portion defines a compartment within the closure. The closure has a circumferential lip formed therein generally at about a periphery of the compartment. The lip defines a channel-like recess adjacent to the compartment.

The closure further includes a removable, circular cover member which is adapted to cover the compartment by insertion into the circumferential recess. The cover has a pair of tab-like, releasable engaging members which are configured to be received in the recess to retain the cover in place over the compartment.

The cover is adapted to be removed from the top wall portion when pressure is applied to the cap on the skirt portion adjacent to where the engaging members are positioned in the recess. Removal of the cover permits access to the compartment.

In accordance with a preferred embodiment, the inwardly recessed top wall portion is concave and defines a pressure responsive surface and an outwardly facing sealing surface adjacent thereto. The sealing surface engages an inwardly facing surface at about the mouth of an associated container, which enhances the sealing capabilities of the closure in response to pressure from a fluid in the container acting upon the surface.

The compartment may contain a promotional element, such as an accordion folded coupon or game piece. The promotional element may further bias the cover outwardly, away from the top wall portion.

The closure cap is configured to permit removal of the cover and access to the compartment only after the closure is removed from the associated container, while advantageously allowing reuse of the closure after access to the compartment without any adverse impact on the sealing characteristics of the closure.

In an alternate embodiment, the closure cover member includes a depending support seal member which coacts with a bead seal on the recessed top wall portion to establish a seal enhancing region where the top wall portion engages the inside surface of the container mouth.

Other features and advantages of the present invention will be apparent from the following detailed description, the accompanying drawings, and the appended claims.

DETAILED DESCRIPTION OF THE PREFERRED EMBODIMENTS

Figure 2:
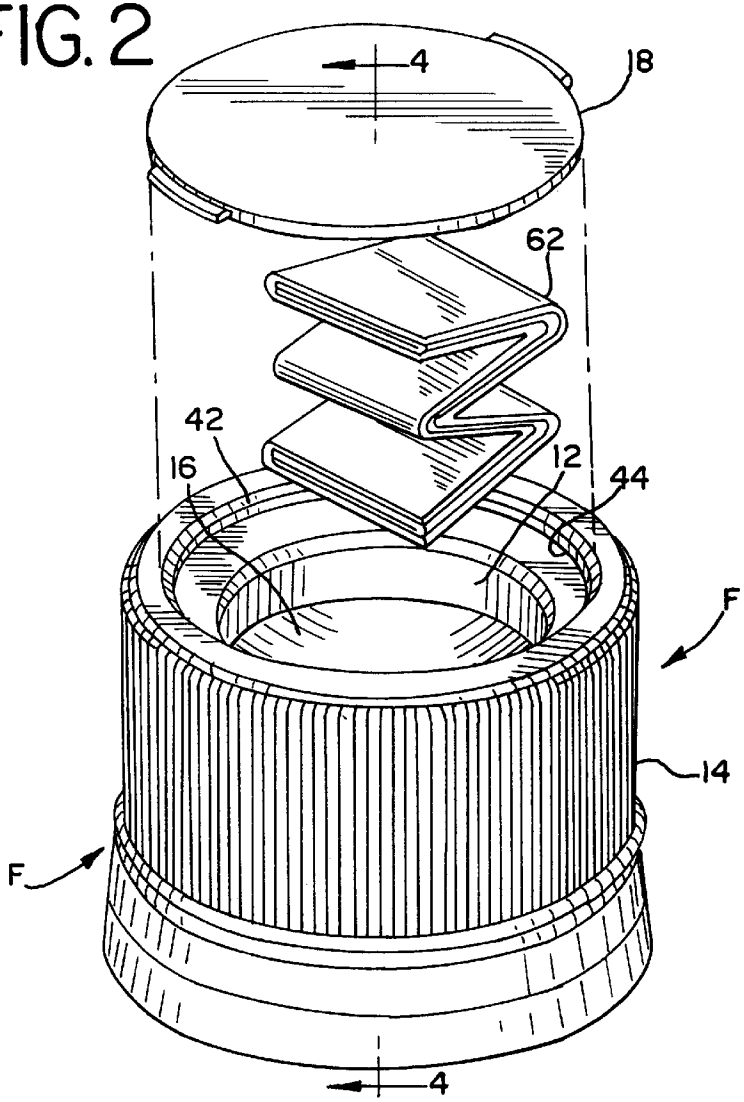
FIG. 2 is an exploded perspective view of the closure of FIG. 1, showing the cover removed therefrom and illustrating an accordion folded promotional element therein.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Figure 1:
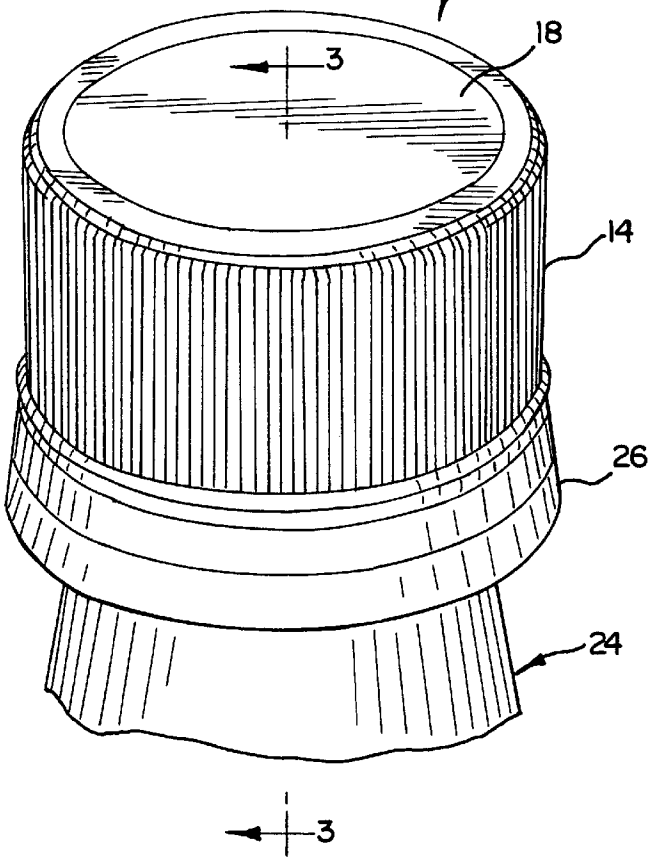
FIG. 1 is a perspective view of a compartmentalized promotional closure in accordance with the principles of the present invention having a removable cover.

With reference now to FIGS. 1 and 2, there is shown a removable top cover promotional closure 10 of the present invention. The closure 10 is generally cup shaped having an inwardly recessed top wall portion 12 and a depending skirt portion 14 depending from the top wall portion 12. The inwardly recessed top wall portion 12 defines a compartment 16 within the closure 10.

The closure 10 further includes a cover member 18 which is adapted to be received in the closure 10, over the compartment 16.

In a preferred embodiment, the skirt portion 14 has an internal thread 20 formation on the inside thereof for threadedly engaging a thread 22 on an associated container 24 to which the closure 10 is fitted. In one embodiment, the closure 10 is formed with a tamper-evident pilfer band 26 to provide visible discernible evidence that the closure 10 has been partially or completely removed from the container 24. The pilfer band 26 is connected to the skirt portion 14 by a plurality of rib-like bridges 28 which extend between the inside surfaces 30, 32 of the skirt portion 14 and the pilfer band 26. The pilfer band is otherwise separated and distinguished from the skirt portion 14 by a circumferential score line 34 which extends through the side wall of the closure and partially into the frangible ribs 28.

The pilfer band 26 can be configured in accordance with the teachings of the aforementioned U.S. Patent to McBride et al. and U.S. Pat. No. 4,938,370 to McBride, and formed attendant to compression molding of the closure according to the teachings of the aforementioned U.S. Patent to Wilde et al., which patents are commonly assigned herewith and which patents are hereby incorporated by reference.

In the exemplary closure 10, the pilfer band 26 has a plurality of inwardly extending tabs 36. Upon initial engagement of the closure 10 to the container 24, the tabs 36 pivot in an upward manner and pass over an annular locking ring 38 of the container 24. Pilfer indication is provided upon first removal of the closure 10 from the container 24 wherein the tabs 36 engage the locking ring 38 which provides sufficient resistance to separate the pilfer band from the skirt portion 14 at the score line 34.

Figure 3:
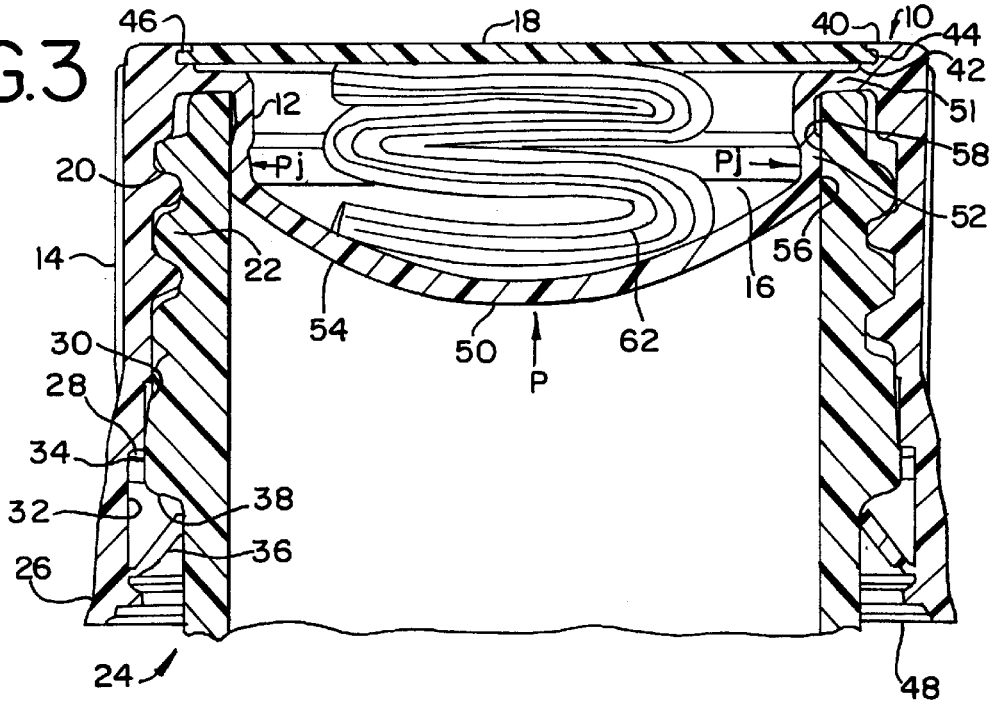
FIG. 3 is a cross-sectional view of the closure of FIG. 1, taken along line 3—3 of FIG. 1, showing the cover in place on the closure and the promotional element stored therein.
Figure 4:
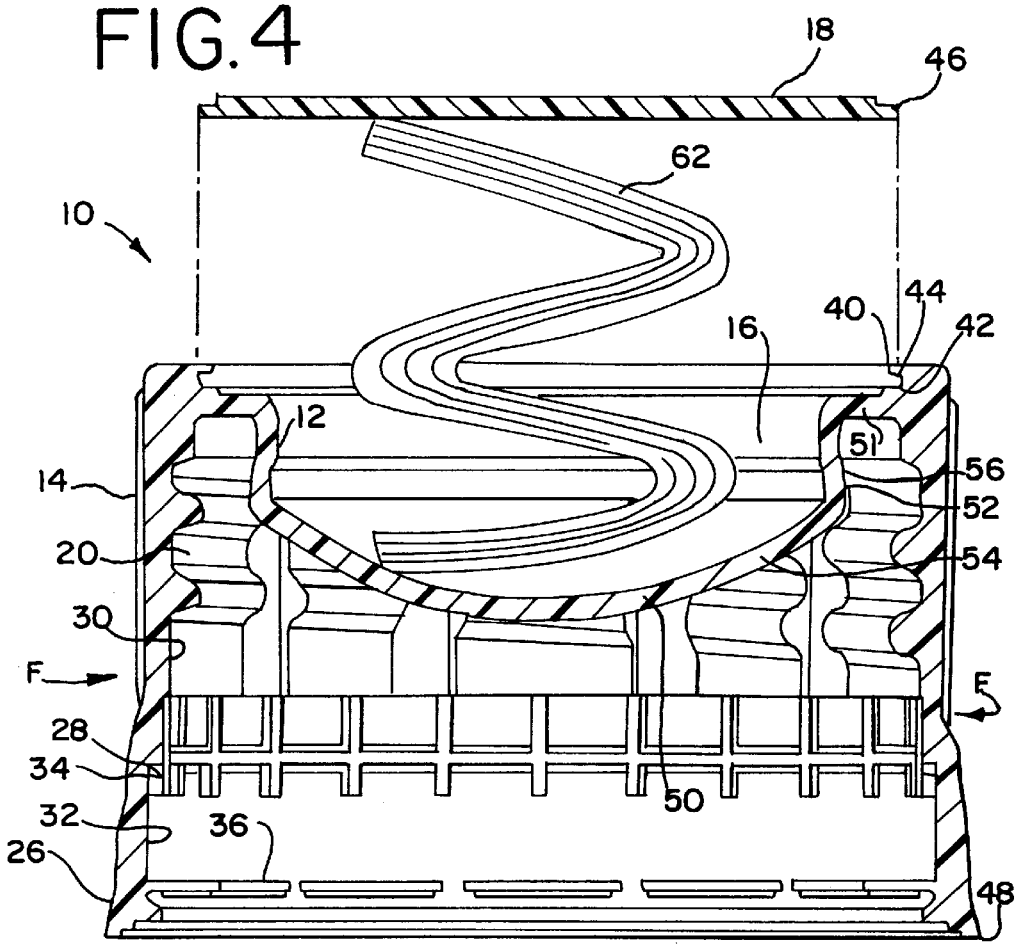
FIG. 4 is cross-sectional view taken along line 4—4 of FIG. 2, showing the cover removed from the closure and the promotional element extending partially outward thereof.

As illustrated in FIGS. 3 and 4, the closure 10 includes a lip 40, preferably at about a periphery 42 of the compartment 16. The lip 40 defines a circumferential channel-like recess 44 adjacent to the compartment 16.

As best seen in FIG. 3, the cover member 18 fits over and covers the compartment 16 by insertion into the closure 10 at about the circumferential recess 44. In one embodiment, the cover member 18 includes a pair of circumferentially opposed tab-like, releasable engaging members 46 which are adapted to be received in the recess 44 adjacent to the compartment 16. The engaging members 46 retain the cover 18 in place in the closure 10.

The engaging members 46 are adapted to release from the recess to permit removal of the cover 18 from the top wall portion 12, to permit access to the compartment 16. The cover 18 is released from the top wall portion 12 by applying pressure to the depending skirt portion 14 adjacent to where the engaging members 46 are positioned in the recess 44, as indicated generally at F in FIGS. 2 and 4. The force exerted on the skirt portion 14 tends to flex or bend the skirt portion 14 inward at the open end 48 adjacent to the areas at which the forces are exerted, and outward at about the circumferential recess 44, longitudinally colinear with the areas at which the forces are exerted. The outward flexing distorts the closure 10 at about the lip 40 which exposes or releases one or more of the engaging members 46 from the recess 44 and permits the cover 18 to be removed.

It is to be understood that the engaging members 46 of the present invention may be configured as a pair of single tab-like elements, as illustrated in FIG. 1. Alternatively, and within the scope of the present invention, the members 46 may be otherwise configured to provide the requisite retention and release functions of the pair of single tab-like elements, exemplary of which is a plurality of elements grouped in pairs and configured to function as provided above.

The recessed top wall portion 12 forms the compartment 16 internal to the closure 10, and is best seen in FIGS. 3 and 4. In the illustrated embodiment, the top wall portion 12 is domed or concave relative to the compartment 16 formed by the wall 12, and defines a pressure responsive surface 50. The compartment 16 may alternatively be formed from downwardly inwardly sloped walls (not shown) which may join to form the compartment, or which may include a flat bottom wall portion (not shown) extending between the sloped walls.

In the illustrated embodiment, the top wall portion 12 includes a circumferential, inwardly extending portion 51 generally transverse to the skirt portion 14 contiguous with a depending annular wall portion 52 which is contiguous with the dome 54 formed in the wall 12. As best seen in FIG. 3, the depending annular wall portion 52 defines an outwardly facing sealing surface 56.

When the closure 10 is in place on a container 24, the sealing surface 56 engages an inwardly facing surface 58 at a mouth portion 60 of the container 24. Fluid pressure from within the container 24 acting on the pressure responsive surface 50 as indicated by the arrow at P, urges the sealing surface into sealing engagement with the inwardly facing surface 58 of the container Essentially, the pressure acting on the pressure responsive surface 50 urges it upwardly into the compartment 16 which in turn urges the sealing surface 50 outwardly, as indicated by the arrows at $P_i$ which enhances the seal between the closure 10 and the container 24.

Illustrated in FIG. 3, the closure 10 is shown with a promotional element 62, such as the exemplary coupon, therein. The illustrated coupon 62 is shown in an accordion folded configuration and is compressed as stored in the compartment 16. Such a folded configuration biases the cover member 18 away from the top wall portion 12, so that when pressure is applied to the skirt portion 14, the biasing coupon 62 urges the cover member 18 away from the compartment 16 thus facilitating removal of the cover 18. It will be recognized by those skilled in the art that the promotional element 62 need not bias the cover member 18 away from the closure 10, but may merely be placed inside the compartment 18.

Another advantageous feature of the present invention is that the compartment 16 can only be accessed, that is, the cover member 18 can only be removed from the closure 10 when the closure 10 is removed from the associated container 24. The interaction of the engaging members 46 and the circumferential recess 44 are such that the cover 18 can only be removed, in normal use, by applying pressure to the skirt portion 14, as generally indicated at F, to release the engaging members 46. This configuration prevents the cover 18 from inadvertently falling out of the closure 10 during handling, and further deters removal of the promotional element 62 while, for example, a soft drink container is stored on a grocery shelf.

It will also be recognized that the cover member 18 itself can constitute the promotional element, with for example, printing on the inside portion thereof facing the compartment. Such an arrangement can be used with or without an additional promotional element 62 located in the compartment 16.

The closure 10 illustrated and described shows a closure 10 having a circumferentially narrow lip 40, which requires a cover member 18 which extends substantially over the closure 10. Alternatively, the lip 40 can extend inwardly of the skirt portion 14, which in turn reduces the diameter of the cover 18 for the compartment 16.

It will also be recognized by those skilled in the art that the closure 10 of the present invention can include a liner (not shown) positioned therein at about the juncture of the top wall portion 12 and the depending skirt portion 14. Such a liner would further enhance the seal between the closure 10 and the associated container 24. Such liners are disclosed in the aforementioned patents to McBride et al., McBride and Wilde et al.

An alternate embodiment 110 of the compartmentalized top cover promotional closure is illustrated in FIGS. 5–8. In this embodiment, the closure includes a circular, recessed top wall portion 112, and a depending skirt portion 114. The skirt portion 114 may include a pilfer band 116 as previously provided herein.

The top wall portion 112 defines a compartment 118 within the closure 110. The top wall portion 112 further includes a circumferential channel-like recess 120 adjacent to the compartment 118, and a circumferential seal bead 122 on the outer surface 124 of the top wall portion 112 which bead extends toward the closure skirt portion 114. The seal bead 122 is configured to coact with a generally inwardly facing surface S, at about the mouth M of the container C, when the closure 110 is in place on the container C.

A cover member 126 fits over the compartment 118 by insertion into the closure 110 at about the recess 120. The cover 126 includes a circumferential lip 128 which extends outwardly from the edge 130 thereof, which lip 128 is adapted to be received in the recess 120. The cover 126 further includes a depending skirt-like seal support member 132 which depends from the cover portion 126.

Figure 5:
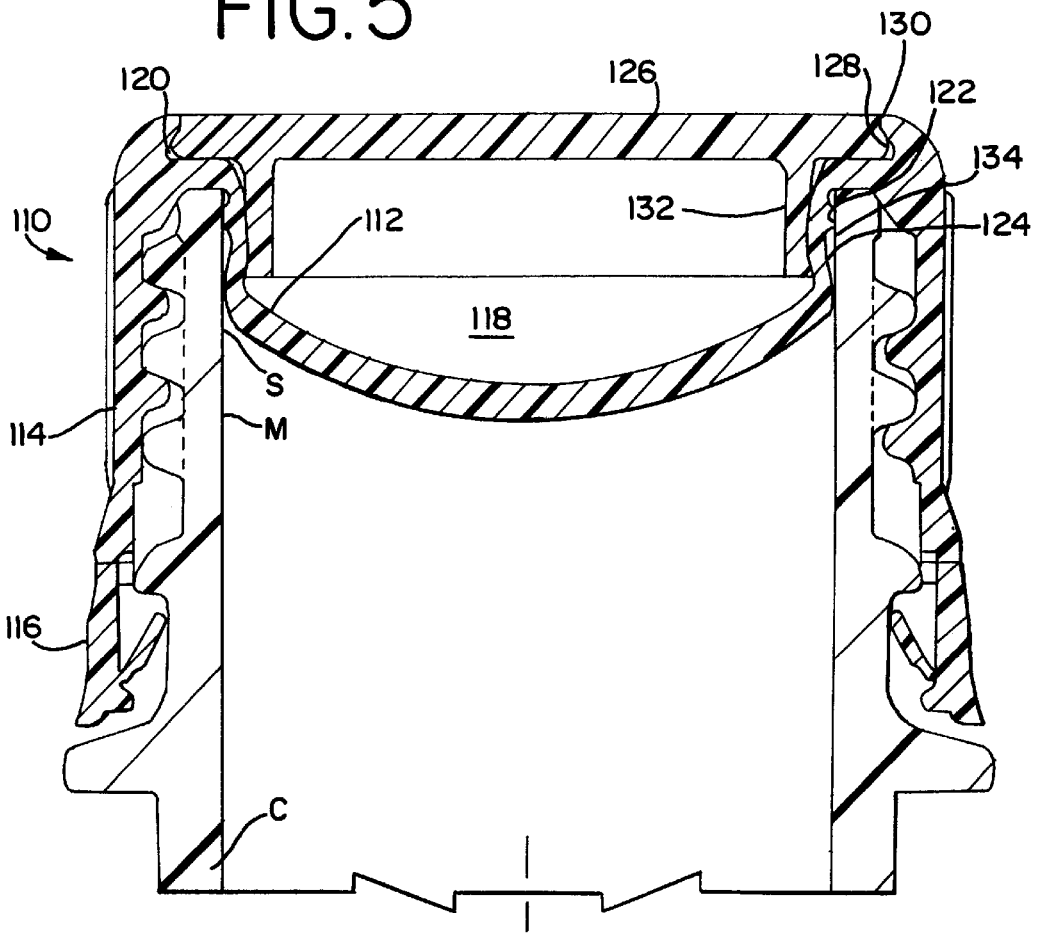
FIG. 5 is a cross-sectional view of an alternate embodiment of a compartmentalized promotional closure of the present invention having a seal support member depending from the cover thereof.
Figure 6:
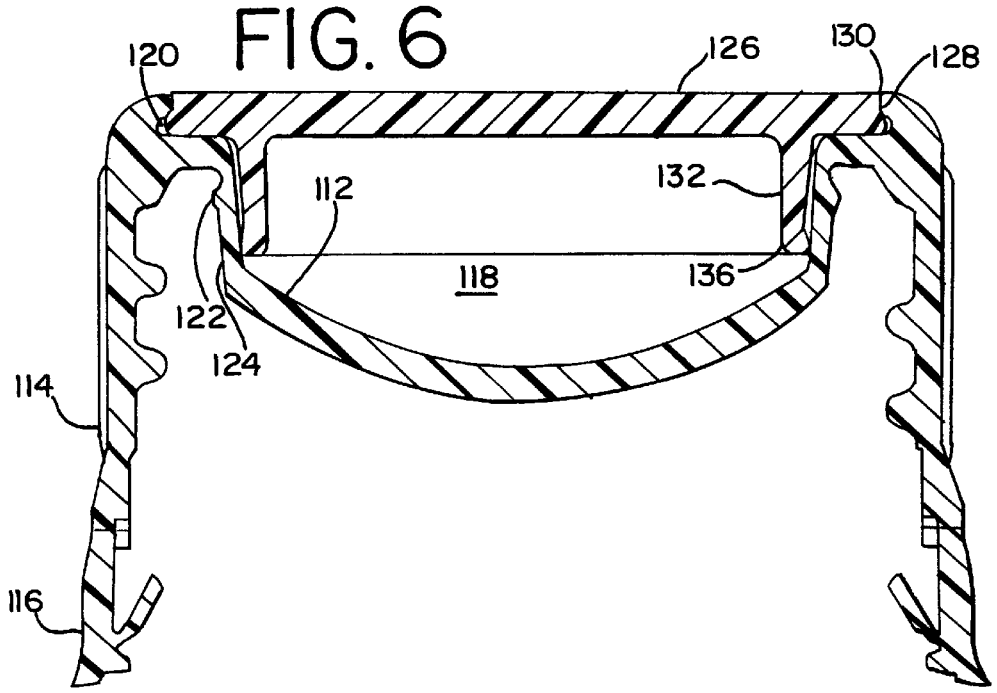
FIG. 6 is a cross-sectional view of an alternate embodiment of the seal support member illustrated in FIG. 5.

As illustrated in FIGS. 5 and 6, when the closure 110 is assembled with the cover 126 in place, the seal support member 132 extends into the compartment 118, abutting the recessed top wall portion 112. Additionally, when the cover 126 is in place, the seal support member 132 exerts an outwardly directed force on the recessed top wall portion 112, directed generally toward the inwardly facing surface S of the container mouth M.

As shown in FIG. 5, the seal support member 132 abutting the top wall portion 112, defines a seal enhancing region between the outer surface of the of the top wall portion 124 and the inwardly facing surface S at the container mouth M, shown generally at 134. The seal support member 132 advantageously enhances the seal by reducing the opportunity for flexing, disturbance and expansion of the closure 110 relative to the container, thus reducing or eliminating leakage.

Within the seal enhancing region 134, the seal support member exerts an outwardly directed force on the recessed top wall portion 112. This, in turn, urges the seal bead 122 into engagement with the inside surface S at the container mouth M to establish a seal between the contents of the container from the environs.

Figure 7:
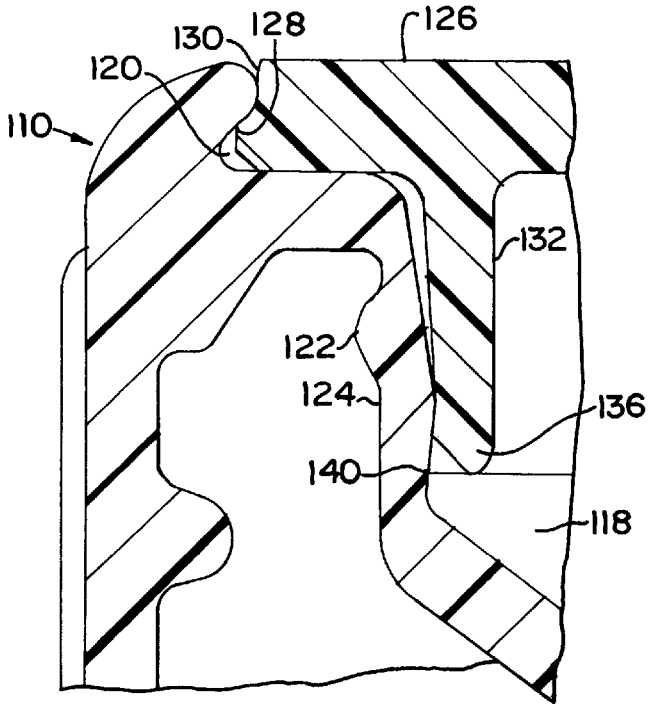
FIG. 7 is a partial cross-sectional view of still another embodiment of the seal support member.
Figure 8:
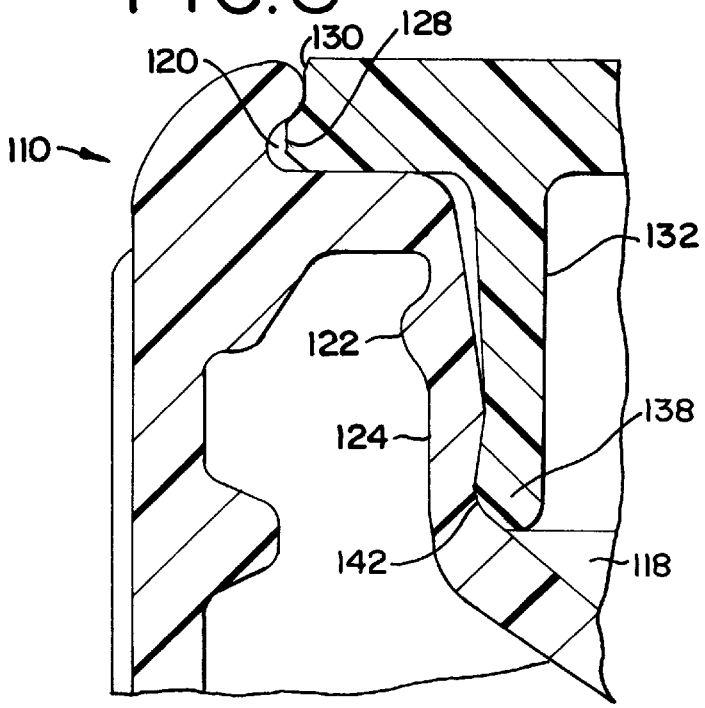
FIG. 8 is a partial cross-sectional view of yet another embodiment of the seal support member.

As shown in FIGS. 6–8, the seal support member 132 may include an outwardly angled end portion 136, or an enlarged or lobed end portion 138 to increase the interaction between the seal support member 132 and the top wall portion 112. As illustrated in FIGS. 7 and 8, the top wall portion 112 may also include a complementarily shaped receiving area 140 and 142, respectively, therein which conforms to the respective end portion 136, 138, and which is configured to receive such a shaped end portion. Alternately, the seal support member 136 end portion may include serrations or other engaging members thereon (not shown) for engaging the inside surface of the top wall portion 112 within the compartment 118. It will be recognized by those skilled in the art that the support member end wall and the recessed top wall portion can be configured in many such shapes, which configuration are within the scope of the resent invention.

Advantageously, such a configuration also provides greater resistance to tampering and removal of the cover member 126 while the containers C are in storage or transit. The coaction of the seal support member and the recessed top wall portion 112 greatly inhibits the ability to remove the cover portion 126 while the closure 110 is on the container C.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A promotional closure for use with an associated container comprising:

a plastic closure cap having an inwardly recessed, circular top wall portion defining a compartment and a depending annular skirt portion depending from the top wall portion;

a circumferential lip formed in the closure cap generally at about a periphery of said compartment, said lip defining a circumferential channel-like recess adjacent to said compartment; and a removable, circular cover member adapted to cover said compartment by insertion into said circumferential recess, said cover having a pair of circumferentially opposed tab-like, releasable engaging members adapted to be received in said circumferential recess to retain said cover in place in the cap over said compartment and further adapted to release from said recess for removal of said cover member from said top wall portion when pressure is applied to the cap on said skirt portion adjacent to where said engaging members are positioned in said recess to thereby permit access to said compartment.

2. The closure of claim 1 wherein said inwardly recessed top wall portion is concave.

3. The closure of claim 2 wherein said inwardly recessed top wall portion defines a pressure responsive surface relative to a fluid contained in the container.

4. The closure of claim 3 wherein said inwardly recessed top wall portion further defines a generally outwardly facing sealing surface engageable with a generally inwardly facing surface at a mouth portion of the container, said sealing surface being urged into sealing engagement with the container in response to fluid pressure acting against said pressure responsive surface.

5. The closure of claim 5 wherein the closure includes an internal thread formed therein which is engageable with a thread formed at about the mouth portion of the container.

6. The closure of claim 1 further including a promotional element and wherein said compartment is adapted to store a promotional element.

7. The closure of claim 6 wherein said promotional element biases said cover member away from said top wall portion.

8. The closure of claim 7 wherein said promotional element is an accordion folded coupon.

9. A promotional closure for use with an associated container comprising:

a plastic closure cap having a concave, circular top wall portion defining a compartment, said compartment being adapted to store a promotional element therein, and a depending annular skirt portion depending from said top wall portion, said top wall portion further defining a pressure responsive surface and an outwardly facing sealing surface adjacent to said pressure responsive surface, said sealing surface being engageable with a generally inwardly facing surface at a mouth of the container, said sealing surface being urged into engagement with the container in response to fluid pressure acting on said pressure responsive surface;

a circumferential lip formed in the closure cap generally at about a periphery of said compartment, said lip defining a circumferential channel-like recess adjacent to said compartment; and a removable, circular cover member adapted to cover said compartment by insertion into said circumferential recess, said cover having releasable engaging members circumferentially located thereon adapted to be received in said circumferential recess to retain said cover in place in the cap over said compartment and further adapted to release from said recess for removal of said cover member from said top wall portion when pressure is applied to the cap on said skirt portion adjacent to where said engaging members are positioned in said recess to thereby permit access to said compartment.

10. The promotional closure of claim 9 further including a pair of circumferentially opposed tab-like, releasable engaging members adapted to be received in said circumferential recess to retain said cover in place in the cap over said compartment.

11. A promotional closure for use with an associated container, comprising:

a plastic closure cap having an inwardly recessed, circular top wall portion defining a compartment and a depending annular skirt portion depending from the top wall portion;

a circumferential lip formed in the closure cap generally at about a periphery of the compartment, said lip defining a circumferential channel-like recess adjacent to said compartment; and a removable, circular cover member adapted to cover said compartment by insertion into said circumferential recess, said cover having a circumferential, releasable engaging member adapted to be received in said circumferential recess to retain said cover in place in the cap over said compartment and adapted to release from said recess for removal of said cover member from said top wall portion, and a depending sealing support member extending generally transversely from said cover member into said compartment and abutting said inwardly recessed top wall portion, and defining a seal enhancement region between an outer surface of said recessed top wall portion and a generally inwardly facing surface at a mouth of the container.

12. The closure of claim 11 further including a circumferential seal bead integral with said outer surface of said recessed top wall portion.

13. The closure of claim 11 wherein said inwardly recessed top wall portion and seal support member define a seal enhancing region engageable with a generally inwardly facing surface at a mouth portion of the container, said seal enhancing region being urged into sealing engagement with the container in response to pressure exerted by said seal support member against said recessed top wall portion.

14. The closure of claim 11 wherein the closure includes an internal thread formed therein which is engageable with a thread formed at about the mouth portion of the container.

15. The closure of claim 11 wherein said depending sealing support member includes an outwardly angled end wall portion.

16. The closure of claim 15 wherein said recessed top wall portion is formed complementary with said outwardly angled end portion.

17. The closure of claim 11 wherein said depending sealing support member includes a lobed end wall portion.

18. The closure of claim 17 wherein said recessed top wall portion is formed complementary with said lobed end wall portion.

19. A package comprising:

a container;

a plastic closure cap for closing said container and having an inwardly recessed, circular top wall portion defining a compartment and a depending annular skirt portion depending from the top wall portion;

a cover engaging region formed in the closure cap; and a removable, circular cover member adapted to cover the compartment by insertion of at least part of said cover into said compartment, said cover being adapted to be received within said cover engaging region and including a depending sealing support member extending generally transversely from said cover member into said compartment and abutting said inwardly recessed top wall portion, and defining a seal enhancement region between an outer surface of said recessed top wall portion and a generally inwardly facing surface at a mouth of the container, said sealing support member extending into said container inwardly of said mouth thereof, where in said sealing support member maintains said cover in place in the cap over the compartment, and is adapted to facilitate release of said cover from the cap to thereby permit access to said compartment.

20. The package of claim 19 wherein said depending sealing support member further includes an engagement member adapted to engage said recessed, circular top wall portion to maintain said cover in place in the cap over the compartment.

21. The package of claim 19 further including a circumferential seal bead integral with an outer surface of said recessed top wall portion.

22. The package of claim 19 wherein the inwardly recessed top wall portion and seal support member define a seal enhancing region engageable with a generally inwardly facing surface at a mouth portion of the container, said seal enhancing region being urged into sealing engagement with the container in response to pressure exerted by said seal support member against the recessed top wall portion.

23. The package of claim 19 wherein the closure includes an internal thread formed therein which is engageable with a thread formed at about the mouth portion of the container.

24. A promotional closure for use with an associated container, comprising:

a plastic closure cap having an inwardly recessed, circular top wall portion defining a compartment and a depending annular skirt portion depending from the top wall portion;

a cover engaging region formed in the closure cap; and a removable, circular cover member adapted to cover the compartment by insertion of at least part of said cover into said compartment, said cover being adapted to be received within said cover engaging region and including a depending sealing support member extending generally transversely from said cover member into said compartment and abutting said inwardly recessed top wall portion, and defining a seal enhancement region between an outer surface of said recessed top wall portion and a generally inwardly facing surface at a mouth of the container, said sealing support member including an outwardly angled end wall portion, wherein said sealing support member maintains said cover in place in the cap over the compartment, and is adapted to facilitate release of said cover from the cap to thereby permit access to said compartment.

25. The closure of claim 24 wherein said recessed top wall portion is formed complementary with said outwardly angled end wall portion.

26. A promotional closure for use with an associated container, comprising:

a plastic closure cap having an inwardly recessed, circular top wall portion defining a compartment and a depending annular skirt portion depending from the top wall portion;

a cover engaging region formed in the closure cap; and a removable, circular cover member adapted to cover the compartment by insertion of at least part of said cover into said compartment, said cover being adapted to be received within said cover engaging region and including a depending sealing support member extending generally transversely from said cover member into said compartment and abutting said inwardly recessed top wall portion, and defining a seal enhancement region between an outer surface of said recessed top wall portion and a generally inwardly facing surface at a mouth of the container, said sealing support member including a lobed end wall portion, wherein said sealing support member maintains said cover in place in the cap over the compartment, and is adapted to facilitate release of said cover from the cap to thereby permit access to said compartment.

27. The closure of claim 26 wherein said recessed top wall portion is formed complementary with said lobed end wall portion.

* * * * *